United States Patent [19]

Grajek

[11] Patent Number: 4,706,841

[45] Date of Patent: Nov. 17, 1987

[54] LOCK PROTECTOR FOR FUEL CAP

[75] Inventor: Leonard A. Grajek, West Allis, Wis.

[73] Assignee: Velvac, Inc., New Berlin, Wis.

[21] Appl. No.: 502,554

[22] Filed: Jun. 10, 1983

[51] Int. Cl.[4] ..... B65D 55/16

[52] U.S. Cl. ..... 220/375

[58] Field of Search ..... 220/375, 339, 356, 85 D, 220/DIG. 19

[56] References Cited

U.S. PATENT DOCUMENTS

| | | | |
|---|---|---|---|
| 1,633,197 | 6/1927 | Snyder | 220/375 X |
| 2,599,472 | 6/1952 | Miller | 220/375 X |
| 3,282,477 | 11/1966 | Henchert | 220/375 X |
| 4,250,349 | 2/1981 | Bennett | 220/375 X |
| 4,261,386 | 4/1981 | Young | 220/375 X |
| 4,318,495 | 3/1982 | Wood | 220/375 |

*Primary Examiner*—Steven M. Pollard

*Attorney, Agent, or Firm*—Bayard H. Michael

[57] ABSTRACT

The flanged head of the lock captures the plastic cup of the lock protector to retain the protector while it functions as a gasket between the lock and the fuel cap. The protector includes a cover which snaps over the cup to seal the lock against the elements. The cover is connected to the cup by an integral strap.

6 Claims, 4 Drawing Figures

LOCK PROTECTOR FOR FUEL CAP

BACKGROUND OF THE INVENTION

Many trucks and (trailer) tractors are provided with fuel tanks exposed to the elements. The fill spout fuel caps are exposed. This means the locks on locking fuel caps are exposed which can result in the lock becoming frozen since the protective dust shutter on the keyhole is not waterproof.

SUMMARY OF THE INVENTION

The object of this invention is to protect the lock of a locking fuel cap from water, dust and dirt. This is accomplished by providing a plastic body which functions as a gasket or seal between the lock and the fuel cap and has upstanding side walls over which a sealing cover snaps. The cover prevents entry of dirt and water. The cover is connected to the body by an integral molded interconnecting strap. The plastic used for the body, cover and strap is a copolymer of polypropylene and ethylene which retains its flexibility at very low temperatures. Other materials having this characteristic can be used.

DETAILED DESCRIPTION OF THE DRAWINGS

Figure 3:
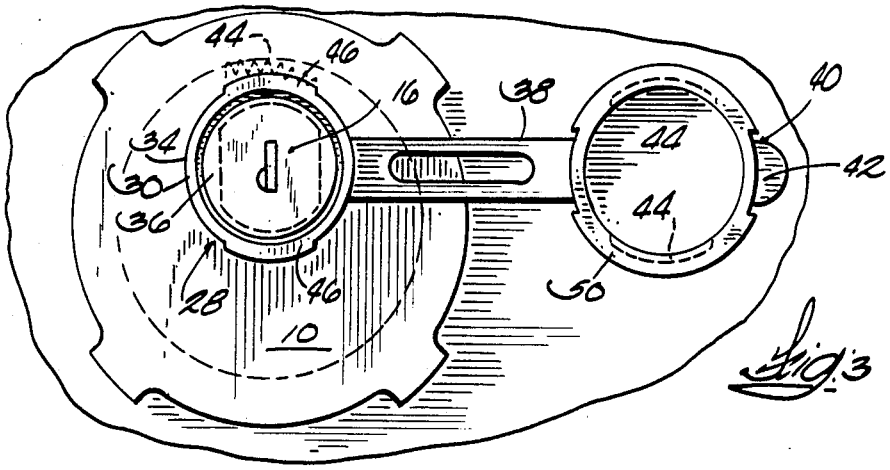
FIG. 3 is a plan view of FIG. 2.
Figure 2:
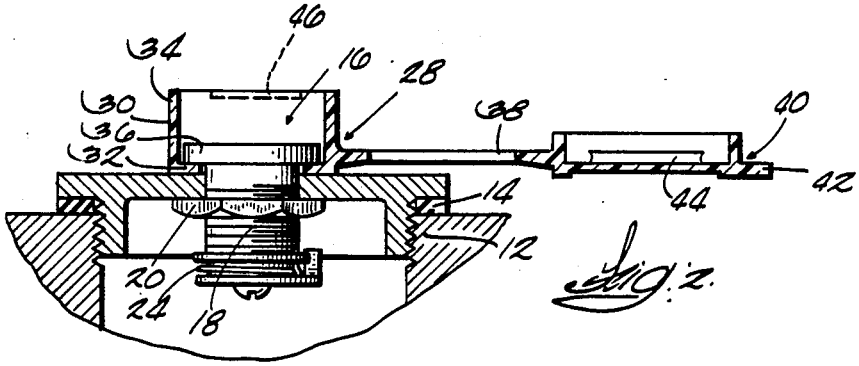
FIG. 2 is a vertical section through the cap connected to a fill spout and having the protective cover open.
Figure 4:
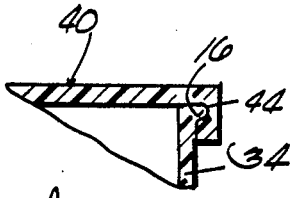
FIG. 4 is an enlarged detail of the snap retention means for the cover.
Figure 1:
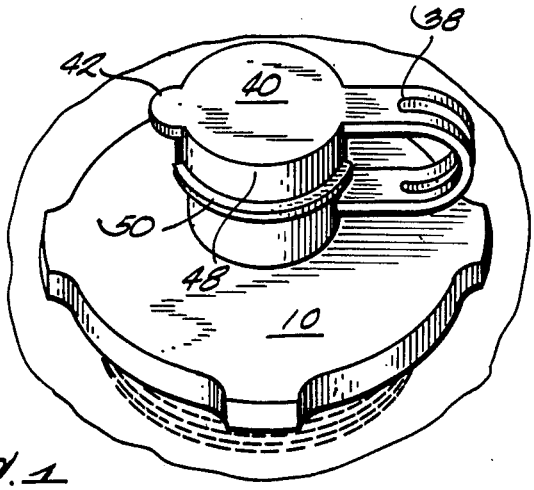
FIG. 1 is a perspective view of the locking gas cap with the protective cover closed.

While the protective cover can be used with many types of fuel caps, it is shown with the fuel cap typically used on the large fuel tanks of over the highway (trailer) tractors. These tanks usually have the fill spout facing upwardly. The tanks are big . . . holding hundreds of dollars worth of fuel and the operators lock the tank with a locking cap. The locks are thus exposed to all sorts of dirt and moisture. This invention protects the lock.

The cap 10 threads into the fill spout 12 and has a gasket 14 which seals against leakage into the tank. The lock 16 mechanism has a threaded body 18 which extends through a hole in the cap. A lock nut 20 threads on the body to fix the body in the cap with the toothed sector 22 engageable with the inside of the fill spout 12 when the cap is locked. The sector can swing to a position in which spring 24 yieldably holds the sector against the spout and allows the cap to be threaded onto the spout, but when the cap is turned to remove the cap, the teeth on the sector dig into the spout and prevent turning the cap. Those details are unimportant to the present invention. Any lock arrangement can be protected by the present protector.

The protector 28 has a cup-like body 30 having a bottom 32 and side wall 34. There is a hole in bottom 32 and the lock body passes through that hole. When the lock nut 20 is drawn up tight, the flanged head 36 of the lock 16 is drawn down on the bottom 32 so the bottom acts as a gasket or seal while the flanged head fixes the protector body 30 on the fuel cap.

The protector includes a flexible strap 38 connecting the cover 40 to the body 30. The cover includes a tab 42 to help the user grasp the cover. The side portions of the cover are provided with opposed inside grooves 44 which snap over the arcuate tongue 46 on each "side" of the upstanding wall 34. This tongue and grove connection holds the cover tightly and prevents entry of water or dirt.

The side wall 34 of the body appears to be higher than necessary but the height provides good space between the tab 42 and the fuel cap and this enables the user to remove the cover easily. The skirt 48 of the cover has a strengthening bead 50 at its outside lower corner except where tooling/molding considerations require no bead so the tab 42 or strap 38 can be molded. As noted above, the copolymer used for the protector retains its flexibility at very low temperatures. Therefore, the plastic will not self-destruct in cold weather.

While not important to this invention, it may be noted the fuel cap would normally be provided with fusible vent plugs.

I claim:

1. A locking fuel cap comprising a fuel cap, a lock including a flanged head and a threaded body extending through a hole in the fuel cap, a lock nut threaded on said body, a lock protector including a cup-like body and a cover, a hole through the bottom of said cup-like body, the threaded body of the lock passing through the hole in the cup-like body so the head of the lock is drawn against and sealed by said protector body as the lock nut is drawn tight.

said cover having a tight fit on said protector body to prevent entry of water.

2. A fuel cap according to claim 1 including a flexible strap integral with and connecting the protector body and cover.

3. A fuel cap according to claim 2 including snap acting means retaining the cover on the protector body.

4. A fuel cap according to claim 3 in which the snap acting means comprise tongue and groove means.

5. A fuel cap according to claim 4 in which the protector is made of a plastic which retains its flexibility at very low temperatures.

6. The combination with a fuel cap provided with a lock having a flanged head on the outside of the cap and a threaded body extending through a hole in the cap and receiving a lock nut on the underside of the cap to fix the lock on the cap, of means protecting the lock from dirt and water, comprising, a cup-like plastic body having a generally flat base and an upstanding side wall having an internal diameter greater than the outside diameter of said flanged head, said base having a hole through which the lock body extends whereby the flanged head fits inside said upstanding side wall and bears against the base and the base seals against entry of dirt or water between the lock and the fuel cap, a plastic cover dimensioned to fit over the upstanding side wall, a flexible strap molded integrally with the plastic body and cover and being unitary therewith, and snap means acting between the cover and body to snugly and releasably retain the cover on the body to effectively seal against water and dirt.

* * * * *